US009328649B2

(12) United States Patent
Kieslich

(10) Patent No.: US 9,328,649 B2
(45) Date of Patent: May 3, 2016

(54) DEVICE FOR LINING THE VISIBLE END OF THE EXHAUST TAILPIPE OF A MOTOR VEHICLE

(71) Applicant: Automobile Patentverwaltungs-und-verwertungsgesellschaft mbH, Luedenscheid (DE)

(72) Inventor: Dirk Kieslich, Plettenberg (DE)

(73) Assignee: Automobile Patentverwaltungs-und-verwertungsgesellschaft mbH, Luedenscheid (DE)

( * ) Notice: Subject to any disclaimer, the term of this patent is extended or adjusted under 35 U.S.C. 154(b) by 0 days.

(21) Appl. No.: 14/374,996

(22) PCT Filed: Feb. 1, 2013

(86) PCT No.: PCT/EP2013/052071
§ 371 (c)(1),
(2) Date: Jul. 28, 2014

(87) PCT Pub. No.: WO2013/113894
PCT Pub. Date: Aug. 8, 2013

(65) Prior Publication Data

US 2014/0374514 A1 Dec. 25, 2014

(30) Foreign Application Priority Data

Feb. 1, 2012 (DE) ..... 10 2012 100 845

(51) Int. Cl.

| | |
|---|---|
| ***B60K 13/06*** | (2006.01) |
| ***F01N 13/20*** | (2010.01) |
| ***F01N 13/08*** | (2010.01) |
| ***F01N 13/16*** | (2010.01) |
| ***F01N 13/18*** | (2010.01) |

(52) U.S. Cl.
CPC ..... *F01N 13/20* (2013.01); *F01N 13/082* (2013.01); *F01N 13/16* (2013.01); *F01N 13/1805* (2013.01); *F01N 13/1838* (2013.01); *F01N 2530/18* (2013.01)

(58) Field of Classification Search
CPC ..... B60R 19/48
USPC ..... 180/309; 293/113; 181/227, 228
See application file for complete search history.

(56) References Cited

U.S. PATENT DOCUMENTS

| | | | | |
|---|---|---|---|---|
| 6,962,230 | B2 * | 11/2005 | Hanaya | B60K 13/04 180/309 |
| 7,007,720 | B1 * | 3/2006 | Chase | F16L 59/12 138/110 |
| 7,686,131 | B1 * | 3/2010 | Osterkamp | F01N 13/001 180/89.2 |
| 7,735,885 | B2 * | 6/2010 | Shin | B60K 13/04 293/113 |

(Continued)

FOREIGN PATENT DOCUMENTS

| | | | |
|---|---|---|---|
| DE | 20 2008 014 864 | U1 | 3/2009 |
| DE | 10 2008 028 735 | A1 | 12/2009 |

OTHER PUBLICATIONS

International Search Report of PCT/EP2013/052071, mailed Jun. 7, 2013.

*Primary Examiner* — Jeffrey J Restifo
(74) *Attorney, Agent, or Firm* — Collard & Roe, P.C.

(57) ABSTRACT

A device for lining the visible end of the exhaust tailpipe of a motor vehicle includes a base support and a trim, wherein the base support and trim are composed of plastic. The trim forms the visible end of the device. The connection of base support and trim is realized by adhesive bonding.

8 Claims, 5 Drawing Sheets

(56) References Cited

U.S. PATENT DOCUMENTS

Figure 1:
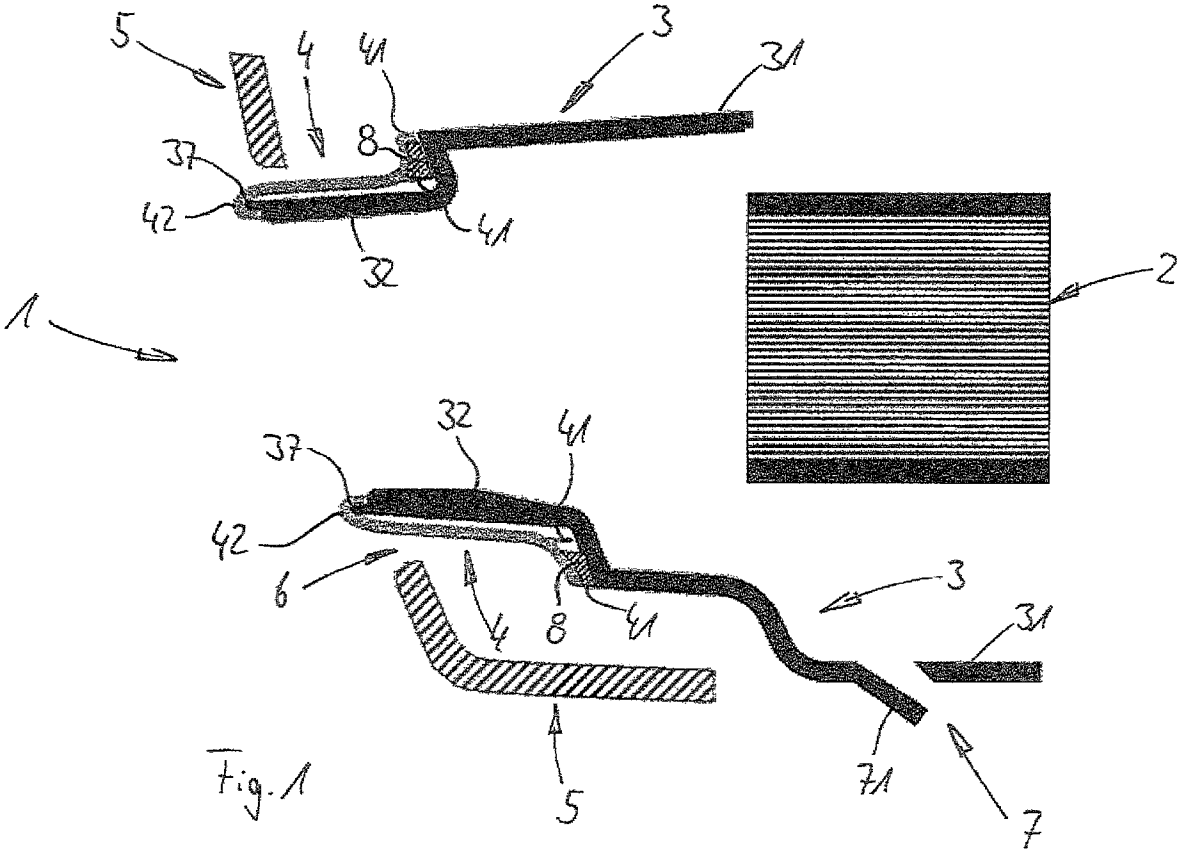

| | | | | |
|---|---|---|---|---|
| 8,312,961 | B2 * | 11/2012 | Won | F01N 13/082 180/309 |
| 8,863,886 | B2 * | 10/2014 | O'Brien | B60R 13/0876 138/110 |
| 2007/0240932 | A1 * | 10/2007 | Van De Flier | B60K 13/04 181/228 |
| 2007/0240934 | A1 * | 10/2007 | Van de Flier | B60K 13/04 181/252 |
| 2008/0036222 | A1 * | 2/2008 | Iwamoto | F01N 13/20 293/113 |
| 2009/0014236 | A1 * | 1/2009 | Van De Flier | B60K 13/04 181/256 |
| 2010/0006369 | A1 * | 1/2010 | Sugiyama | B60K 13/04 181/228 |
| 2010/0096865 | A1 * | 4/2010 | McKee | B60K 13/02 293/113 |

* cited by examiner

DEVICE FOR LINING THE VISIBLE END OF THE EXHAUST TAILPIPE OF A MOTOR VEHICLE

CROSS REFERENCE TO RELATED APPLICATIONS

This application is the National Stage of PCT/EP2013/052071 filed on Feb. 1, 2013, which claims priority under 35 U.S.C. §119 of German Application No. 10 2012 100 845.0 filed on Feb. 1, 2012, the disclosure of which is incorporated by reference. The international application under PCT article 21(2) was not published in English.

The invention relates to an apparatus for covering the visible end of an exhaust tailpipe of a motor vehicle, comprising a base support and a trim, wherein the base support and the trim consist of plastic, and the trim forms the visible end.

Apparatuses of the type stated initially have the task of improving the optical impression of the exhaust system of motor vehicles. In part, the apparatuses also fulfill the task of guiding the exhaust gas stream of the exhaust systems. In many cases, the apparatuses are attached to a rear skirt or a bumper of the motor vehicle.

Such an apparatus is known, for example, from U.S. Pat. No. 7,007,720 B1. It describes a trim for exhaust gas systems, in which an insulating heat shield is disposed around the end of an exhaust gas tailpipe, which shield in turn is enclosed by a decorative trim. Exhaust gas tailpipe, heat shield, and trim form the visible free end of the exhaust gas system. Not only the exhaust gas tailpipe and the heat shield but also the heat shield and the decorative trim stand in contact with one another by way of spacers. The known apparatus demonstrates the disadvantage, among other things, that despite the trim, the exhaust gas tailpipe is visible, and that a temperature transfer from the exhaust gas tailpipe to the trim, as well, takes place due to the direct contact of the components with one another.

In contrast to this, DE 10 2008 028 735 A1 proposes an exhaust tailpipe trim for motor vehicles that is configured in multiple parts, and in which a chrome-plated component forms the visible end of the exhaust tailpipe. This component is pushed onto the adjacent component, attached to it, and lies against it over its full area. The great heat transfer that is possible as a result has a negative effect on the selection of suitable materials. The known exhaust tailpipe trim therefore uses polyetherketone (PEK), polyetheretherketone (PEEK), or the like, among other things. Although these are high-strength materials, they cannot be competitively used in motor vehicle construction, due to economic aspects.

Furthermore, an end trim for exhaust gas systems in motor vehicles is known from DE 20 2008 014 864 U1, which trim is produced from thermoplastic and duroplastic plastics. It consists of a pot region and a trim, whereby the trim is visible on the outside of the vehicle rear. Trim and exhaust pot can consist of two components, whereby these are mechanically connected with one another. In this connection, the trim can be galvanized in order to improve the optical impression.

It is true that the known end trims for exhaust gas systems in motor vehicles do fundamentally fulfill the requirements set; however, they demonstrate the disadvantage that on the one hand, they do not cover the visible end of the exhaust tailpipe, and on the other hand, large contact surfaces between the trim and the pot region exist. For this reason, the high exhaust gas temperatures that act on the pot region are directly transferred to the trim. This has the result that the extremely high temperature resistance values required for the pot region must also be a basis in the material selection for the trim. Therefore the selection of plastics used is restricted. For perfect functioning, it is required to use very temperature-resistant plastics, and this increases the costs for the production of the end trim.

This is where the invention wishes to provide a remedy. The invention is based on the task of creating an apparatus for covering the visible end of the exhaust tailpipe of a motor vehicle in which the trim is exposed to lower temperatures than the remaining part of the apparatus. According to the invention, this task is accomplished in that the connection of base support and trim takes place by means of adhesive bonding.

With the invention, an apparatus for covering the visible end of the exhaust tailpipe of a motor vehicle is created, in which the transfer of the temperatures acting on the base support to the trim is reduced. This is brought about in that adhesive bonding is selected for connecting the parts of the apparatus. Adhesive banding offers the advantage that a lesser-heat transfer from the base support to the trim bonded to it takes place.

In a further development of the invention, the adhesive bonding takes place only in certain regions. By means of this embodiment, the contact locations between base support and trim are kept low. As a result, few contact locations between the parts, at which heat transfer can take place, are created. As a result, the thermal stress on the trim is additionally reduced.

It is advantageous if the adhesive bond is formed by an adhesive bead. The use of an adhesive bead offers the advantage of bringing about an approximately ring-shaped attachment of the components with one another. All that is required is to provide the adhesive bead in certain regions; the connection between the parts of the apparatus brought about by this is sufficient for meeting the mechanical and thermal stresses of the apparatus.

In the case of apparatuses having a large construction, in particular, which are preferably used in very high-priced motor vehicles, the possibility exists of providing mechanical engagement connections between base support and trim.

Preferably, an air collector is configured on the base support, the side facing the ground. The air collector allows guiding the air stream into the apparatus, specifically into the region between exhaust tailpipe and base support. This leads to a reduction in the exhaust gas temperature flowing through the apparatus, thereby reducing the thermal stress on the apparatus.

In another further development of the invention, a heat protection plate is disposed on the base support, on its inside, thereby bringing about improved protection against thermal stresses of the exhaust gas stream.

Particularly preferably, the heat protection plate is disposed on the inside of the base support, on the side facing the ground, because the greatest thermal stresses of the exhaust gas stream act on the base support in this region, whereby the temperatures there can amount to as much as 500° C.

Figure 2:
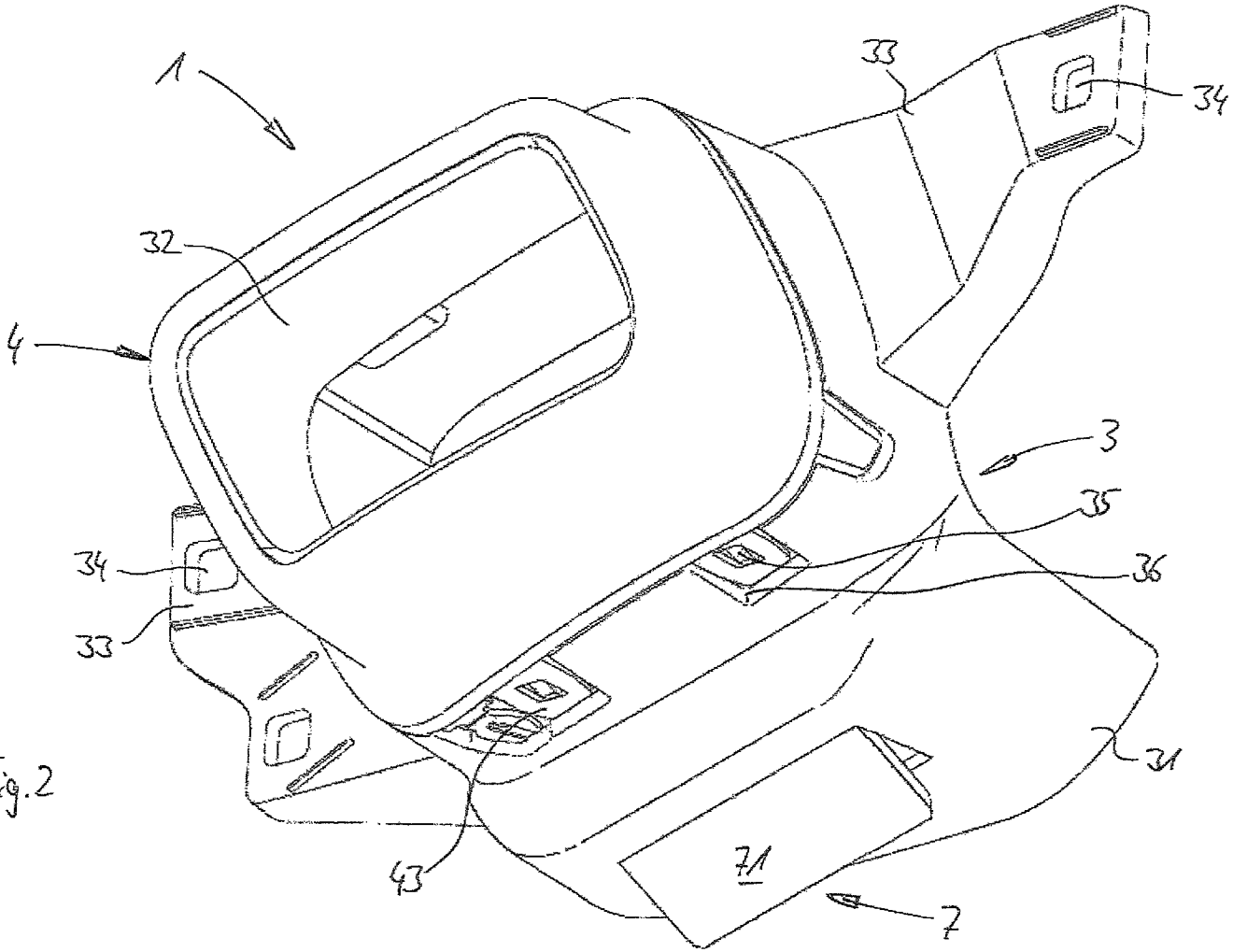
Figure 3:
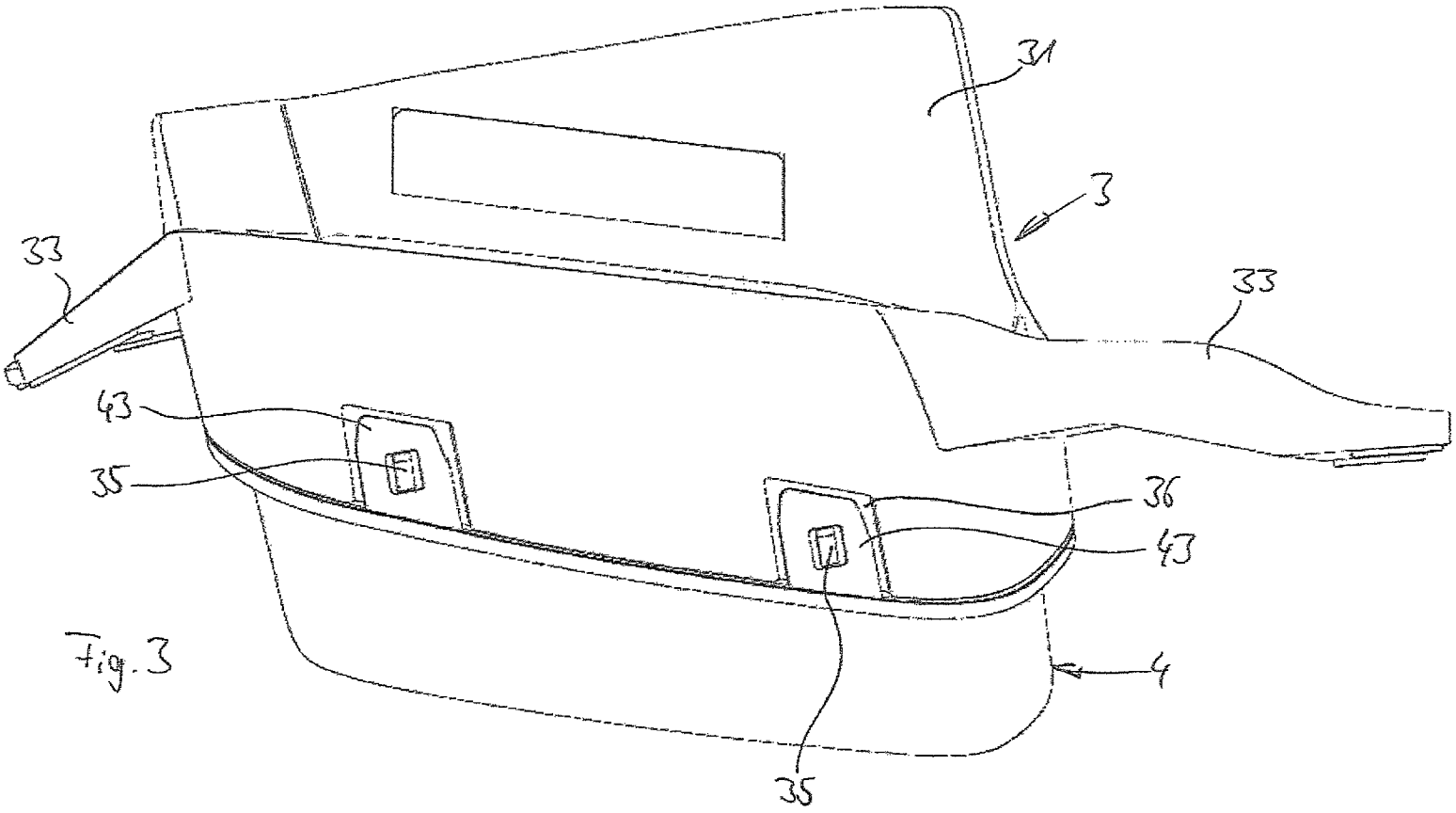
Figure 4:
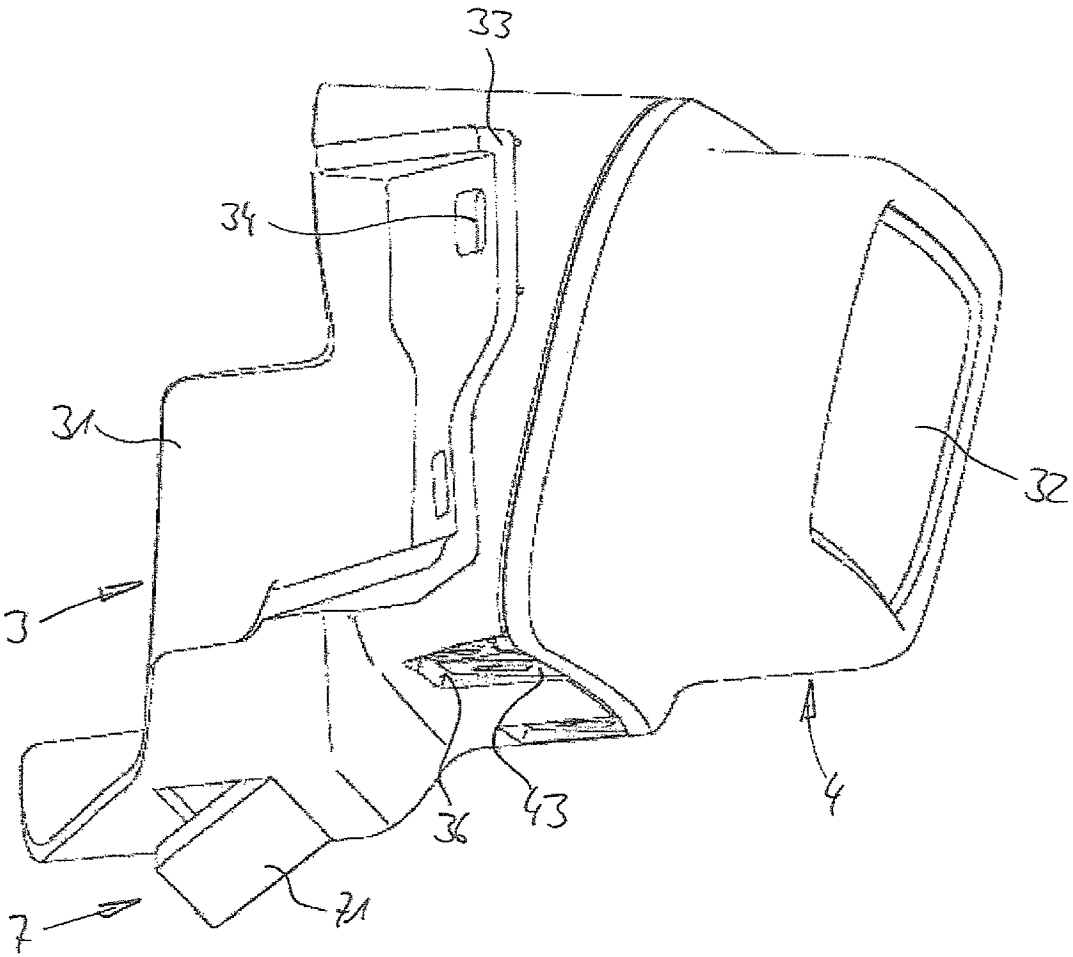
Figure 5:
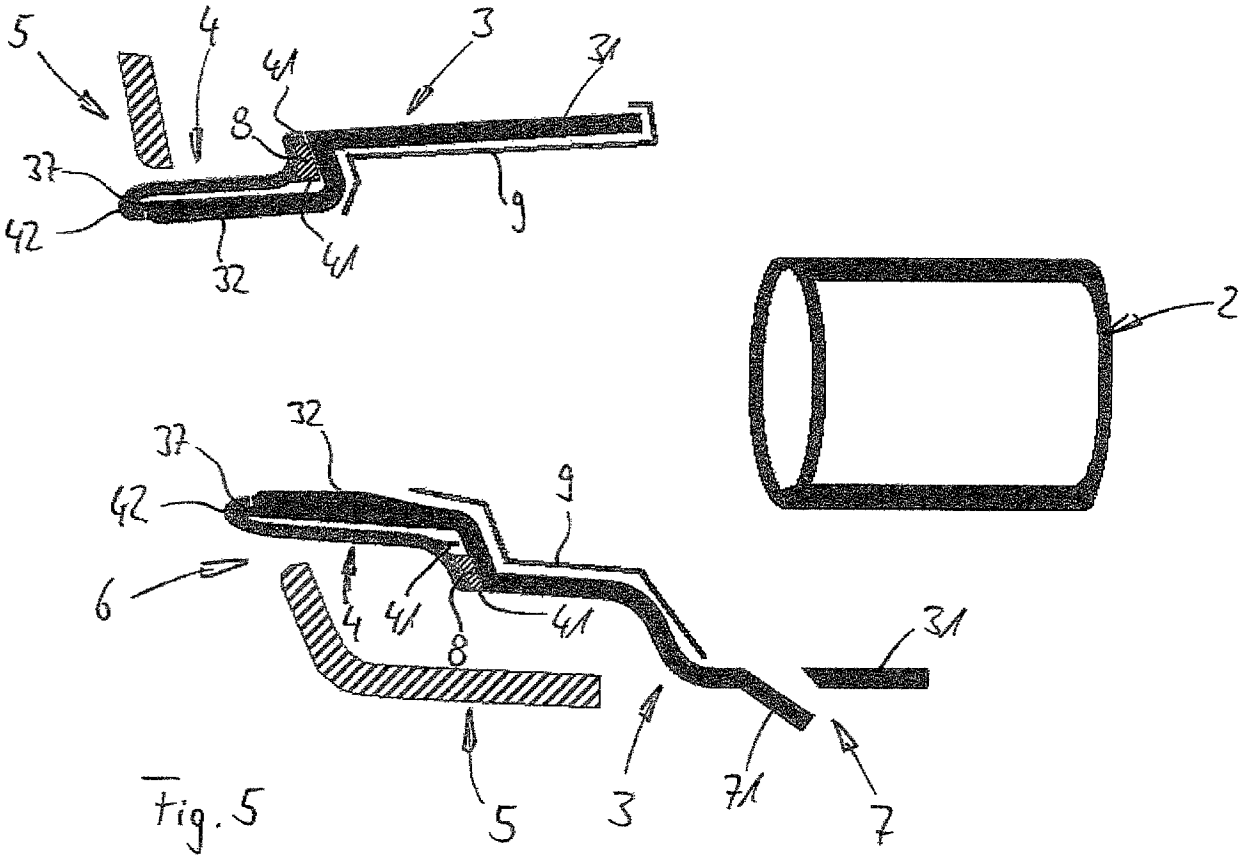

Other further developments and embodiments of the invention are indicated in the remaining dependent claims. An exemplary embodiment of the invention is shown in the drawing and will be described in detail below. The figures show:

FIG. 1 the schematic representation of the cross-section through the apparatus for covering the visible end of the exhaust tailpipe of a motor vehicle;

FIG. 2 the three-dimensional representation of a view from below of the apparatus according to the invention;

FIG. 3 the top view of the apparatus according to the invention;

FIG. 4 the side view from the left of the apparatus according to the invention;

FIG. 5 the schematic representation of the cross-section through the apparatus for covering the visible end of the exhaust tailpipe of a motor vehicle, in another embodiment.

The apparatus 1 for covering the visible end of an exhaust tailpipe 2 of a motor vehicle, selected as an exemplary embodiment, comprises a base support 3 and a trim 4. The trim 4 forms the visible end of the apparatus. In the exemplary embodiment according to FIG. 1, the apparatus 1 is disposed behind a skirt 5 on the rear of a motor vehicle. The skirt 5 has an opening 6 for the apparatus 1 to pass through.

The base support 3 consists of plastic. Preferably, the plastic is a thermoplastic or duroplastic plastic. Combinations of plastics are also possible. The base support 3 is structured as a complex three-dimensional entity. It has a base part 31 followed by a tubular end piece 32. The base part 31 is provided with flanges 33 that extend essentially at a right angle to the longitudinal center line of the base support 3. The flanges 33 are provided with holes 34, in each instance, through which screws—not shown—are passed, in order to undertake fastening of the apparatus 1 to the skirt 5 of the motor vehicle. The base part 31 is provided with engagement projections 35 both on its top and on its underside, which projections are disposed in essentially rectangular depressions 36. On its end facing the viewing side of the apparatus 1, the end piece 32 has a crosspiece-like material narrowing 37.

The trim 4 also consists of plastic. For the trim 4, as well, thermoplastic and/or duroplastic plastics can be used. Here, too, a combination of the stated plastics is possible. The trim 4 is provided with a metallic or galvanized surface, in order to improve the optical impression of the exhaust system as a whole. The trim 4 is configured in the manner of a tubular piece. It has an inside diameter that is greater than the outside diameter of the end piece 32 of the base body 3, in order to be able to cover the latter. It is provided with crosspieces 41 on its end facing away from the viewing side of the apparatus 1, which crosspieces can come to lie against the base support 3 at the transition between its base part 31 and the end piece 32.

On the end facing away from the crosspieces 41, the trim 4 is provided with a fold 42. In the installed state of the apparatus 1, the fold 42 encloses the material narrowing 37 of the end piece 32, as can particularly be seen in FIG. 1. Consequently, not only the face-side end but also the outside of the base support 3 are not visible from the viewing side of the apparatus 1. Only the high-quality coated trim 4 can be seen from the outside, and this brings about a very high-quality impression of the exhaust system as a whole.

In the material narrowing 37 of the base support 3 and the crosspieces 41, as well as the fold 42 of the trim 4, interruptions—not shown—that lie one on top of the other and cover essentially the same area can be provided, in each instance. By means of the interruptions disposed one on top of the other, openings are brought about, which allow the entry of air into the region between base support 3 and trim 4, thereby bringing about ventilation. This process is reinforced in that the speeds of the exhaust gases that exit from the exhaust tailpipe 2 and leave the apparatus 1 through the end piece 32, which speeds are high during operation, bring about a suction that causes a large volume stream of fresh air to flow through the region between base support 3 and trim 4. The possibility is created of conveying the heat emitted by the end piece 32 away from this intermediate region. By means of the contact of the inside of the end piece 32 with the exhaust gases that exit from the exhaust tailpipe 2, this temperature is higher than that of the trim 4. Because of the dissipation of heat as a result of the entry of the air stream through the interruptions, cooling is brought about, which prevents excess thermal stress on the trim 4.

On the side facing away from the fold 42, engagement surfaces 43 are formed on the trim 4, which are provided with an opening at their center. The openings in the engagement surfaces 43 correspond with the engagement projections 35 of the base support 3. Likewise, the extent of the engagement surfaces 43 corresponds to the shape of the depressions 36 of the base support 3, as can particularly be seen in FIGS. 2 and 3. Because of the corresponding configuration of the engagement surfaces 43 with the depressions 36, a flush fit of the trim 4 with the base support 3 is brought about in this region, as well.

On the side of the apparatus 1 facing the ground, an air collector 7 is formed in the base support 3. The air collector 7 is formed by a shield 71 that is oriented at an angle from the horizontal. The air collector 7 allows entry of the air stream into the apparatus 1, specifically into the region between exhaust tailpipe 2 and base support 3. The entering fresh air brings about a reduction in the exhaust gas temperature in the region of the tubular end piece 32, and this reduces the stresses and, at the same time, increases the useful lifetime of the apparatus.

In a further embodiment, a heat protection plate 9 is disposed on the base support 3, on its inside (see FIG. 5). In the exemplary embodiment, the heat protection plate 9 is disposed on the inside of the base support 3, on the side facing the ground—the lower side—and the side facing away from the ground—the upper side, and this represents protection against the very high temperatures of the exhaust gas stream. The base support 3 is thereby better protected against thermal stresses. It is also possible to affix a heat protection plate 9 only on the lower inside of the base support 3. It can be seen that the heat protection plate 9 encloses the face-side end of the base support 3. In this way, an additional edge protection for the base support 3 is brought about, which prevents abrasion due to the impact of stones, for example. At the same time, however, the high-quality optical impression of the visible end of the exhaust tailpipe 2 is not negatively influenced, because the trim 4 covers the face-side end of the base support 3 with its fold 42, and the heat protection plate 9 is not visible.

In the exemplary embodiment, the heat protection plate 9 and the base body 3 form what is called a hybrid component. In this connection, the heat protection plate 9 is affixed directly to the base body 3. This takes place in that the heat protection plate 9 is laid into the mold during the production of the base body 3, composed of plastic, before the process of injection molding, and therefore forms a non-releasable unit with the base body 3 after injection molding and subsequent cooling. Alternatively, the heat protection plate 9 can be mounted on the base body 3 after the latter has been completed.

The connection of base support 3 and trim 4 takes place by means of adhesive bonding. The adhesive bonding takes place only in certain regions, in order to reduce the contact locations between base support 3 and trim 4 in this way, as well, and to reduce a heat transfer from the base support 3, which is subject to greater thermal stress, to the trim 4. Furthermore, adhesive bonding only in certain regions offers the possibility of allowing the air drawn in through the interruptions to flow into the region between base support 3 and trim 4 without hindrance.

In the exemplary embodiment, the adhesive bond is formed by an adhesive bead 8. This bead is situated on the face-side end of the trim 4, facing away from the viewing side. In the exemplary embodiment according to FIG. 1, the adhesive bead 8 is disposed between the crosspieces 41 of the trim 4. A polyurethane adhesive is preferably used as an adhesive. This is characterized, for one thing, by great adhesive strength, and for another thing, this adhesive is suitable for reliably connecting even components that are exposed to great thermal stresses with one another. Preferably, a two-component adhesive is used, which furthermore is characterized by great strength values under static and dynamic conditions.

With the invention, an apparatus for covering the visible end of the exhaust tailpipe of a motor vehicle is created, which on the one hand improves the optical impression of the exhaust system of the motor vehicle, in each instance. On the other hand, because of the exclusive use of plastics within the apparatus, the weight is clearly reduced in comparison with the known trims composed of stainless steel. Because of the design configuration of the apparatus as described above, it is furthermore possible to use plastics that can be economically used, in comparison with the plastics used in the state of the art. In the exemplary embodiment, ABS/PC is used for the galvanizable trim, for example, whereby preferably, PA or PARA or PPA is used. The use of these high-temperature-resistant and mechanically very stable materials furthermore offers the possibility of reducing the wall thicknesses of both the base support 3 and of the trim 4, and this leads to a further cost advantage on the basis of the lesser amount of material used, on the one hand, and on the other hand results in an additional weight saving.

Furthermore, the possibility exists, because of the adhesive bonding of base body 3 and trim 4, of allowing a reliable connection that is easy to handle, at the same time. The placement of the adhesive bond in the region of the face-side side of the trim 4, facing away from the viewing side, furthermore offers the possibility of incorporating it into the installation process in simple manner. This has its cause in that the trim 4 completely encloses the end piece 32 of the base support 3. Consequently, the possibility exists, in simple manner, during assembly of the apparatus 1 by means of joining of the base support 3 and the trim 4, of simply pushing the latter onto the end piece 32 from the viewing side of the apparatus 1. While it is being pushed on, the adhesive bead 8 has already been applied to the face-side end of the trim 4. When the trim 4 makes contact with the transition region between base part 31 and end piece 32, the bond is made using the adhesive. At the same time, in this state, the fold 42 of the trim 4 encloses the material narrowing 37 of the base support 3. If the engagement connections shown in FIGS. 2 and 3 are provided on the apparatus 1, these are in engagement in the stated position.

Furthermore, because of the merely point-like contact between base support 3 and trim 4, heat transfer from the end piece 32, which is subject to great thermal stress, to the trim 4 is clearly reduced as compared with the solutions known from the state of the art. This heat transfer is furthermore further reduced if the air collector 7 is used. By means of the entry of the air stream, the heat emitted by the end piece 32 is transported away out of the region between end piece 32 and trim 4. This effect is reinforced in that the exhaust gas stream exiting from the exhaust tailpipe 2 and the placement of the air collector 7 in a region that is situated ahead of the free end of the exhaust tailpipe 2 in the flow direction of the exhaust gas triggers an effect in the manner of a Venturi jet. As a result, the heat emitted can be transported away even better from the region between end piece 32 and trim 4. Particularly in the case of adhesive bonding of the components of the apparatus 1 only in certain regions, entry of the air stream is possible.

In total, a solution is created with the apparatus according to the invention, which allows a weight saving of 30 to 50% as compared with the stainless steel variants usually used. Furthermore, the configuration composed of plastic offers improved design freedom, so that the configuration can be provided with tighter radii, for example. Also, lower processing tolerances can be adhered to. In comparison with the known variants made from plastic, and the plastics mentioned there, the apparatus according to the invention, because of its design, offers the possibility of using plastics that can lead to a cost reduction of more than 200%.

The invention claimed is:

1. Apparatus for covering the visible end of the exhaust tailpipe of a motor vehicle, comprising a base support and a trim, wherein the base support and the trim are composed of plastic, and the trim forms the visible end, wherein a gap is formed between the tailpipe and the base support, wherein the connection of the base support and the trim takes place via adhesive bonding, wherein an air collector is configured on the base support, on the side facing the ground, and wherein the air collector is formed by a shield that is orientated at an angle from the horizontal.

2. Apparatus according to claim 1, wherein the adhesive bonding takes place in certain regions.

3. Apparatus according to claim 1, wherein the adhesive bond is formed by an adhesive bead.

4. Apparatus according to claim 1, wherein mechanical engagement connections are provided between the base support and the trim.

5. Apparatus according to claim 1, wherein interruptions that lie one on top of the other, covering essentially the same area, are provided in the base support and the trim.

6. Apparatus for covering the visible end of the exhaust tailpipe of a motor vehicle, comprising a base support and a trim, wherein the base support and the trim are composed of plastic, and the trim forms the visible end, wherein a gap is formed between the tailpipe and the base support, wherein the connection of the base support and the trim takes place via adhesive bonding, wherein a heat protection plate is disposed on the base support, on its inside.

7. Apparatus according to claim 6, wherein the heat protection plate is disposed on the base support, on the inside of the base support, on the side facing the ground.

8. Apparatus according to claim 6, wherein the heat protection plate encloses the face-side end of the base support.

* * * * *